US007905652B2

(12) United States Patent
Tsai

(10) Patent No.: US 7,905,652 B2
(45) Date of Patent: Mar. 15, 2011

(54) LED STRING LIGHT

(76) Inventor: Nei Cheng Tsai, Zhonghe (TW)

( * ) Notice: Subject to any disclaimer, the term of this patent is extended or adjusted under 35 U.S.C. 154(b) by 285 days.

(21) Appl. No.: 12/340,227

(22) Filed: Dec. 19, 2008

(65) Prior Publication Data

US 2010/0157588 A1 Jun. 24, 2010

(51) Int. Cl.
*H01R 33/00* (2006.01)

(52) U.S. Cl. ..... 362/657; 362/652

(58) Field of Classification Search ..... 362/121–124, 362/236, 249, 249.02, 249.06, 249.11, 249.14, 362/249.16–249.19, 311.13, 377, 378, 391, 362/545, 644, 647, 652, 653, 654, 655, 800, 362/806; 313/498, 318.09; 439/611, 616, 439/617, 619, 692, 699.1, 699.2
See application file for complete search history.

(56) References Cited

U.S. PATENT DOCUMENTS

| | | | | |
|---|---|---|---|---|
| 6,066,004 | A * | 5/2000 | Shen | 439/617 |
| 7,334,919 | B2 * | 2/2008 | Wu | 362/267 |
| 7,784,993 | B2 * | 8/2010 | Yu | 362/657 |
| 2003/0015968 | A1 * | 1/2003 | Allen | 315/185 R |
| 2008/0143234 | A1 * | 6/2008 | Yu | 313/318.08 |

* cited by examiner

*Primary Examiner* — Hargobind S Sawhney
(74) *Attorney, Agent, or Firm* — Muncy, Geissler, Olds & Lowe, PLLC

(57) ABSTRACT

A light-emitting diode (LED) string light includes at least two conductive wires, a plurality of LED units, and a plurality of enclosures. The LED string light is characterized in that each of the LED units has leads inserted perpendicularly into the conductive wires to establish electrical connection therebetween and allow the bottom of the LED unit to abut against ends of the conductive wires. Each of the enclosures has two through holes formed therein for the conductive wires to pass through, respectively, and an upper end provided with an accommodating space for receiving and enclosing a lower portion of the LED unit and part of the conductive wires. Thus, the LED string light can be manufactured easily and efficiently with low labor cost.

6 Claims, 7 Drawing Sheets

LED STRING LIGHT

BACKGROUND OF THE INVENTION

1. Technical Field

The present invention relates to a light-emitting diode (LED) string light and, more particularly, to an LED string light that can be manufactured easily and efficiently with low labor cost.

2. Description of Related Art

Nowadays, commercially available LED string lights are manufactured typically by inserting leads of LED units directly into ends of conductive wires or by using a coupling mechanism to couple the leads of the LED units with the ends of the conductive wires. Therefore, not only are a considerable amount of time and labor required for assembling the LED units and the conductive wires, but also the LED string lights thus produced may have unstable quality due to the complicated manufacturing process.

BRIEF SUMMARY OF THE INVENTION

In view of the above-cited drawbacks of the existing LED string lights, the inventor of the present invention conducted extensive study on the structure of LED string lights and explored ways to simplify the manufacturing process, and increase the production, of LED string lights so as to make quality, high-precision LED string lights. Finally, an LED string light was successfully developed and disclosed herein.

The present invention provides an LED string light that can be manufactured easily and efficiently with low labor cost.

The disclosed LED string light includes at least two conductive wires, a plurality of LED units, and a plurality of enclosures. The LED string light is characterized in that each of the LED units has leads inserted perpendicularly into the conductive wires to establish electrical connection therebetween and allow the bottom of the LED unit to abut against ends of the conductive wires. In addition, each of the enclosures has two through holes formed therein for the conductive wires to pass through, respectively, and an upper end provided with an accommodating space for receiving and enclosing a lower portion of the LED unit and part of the conductive wires.

In the disclosed LED string light, the leads of the LED unit are partially bent at a distance from the bottom of the LED unit, and the distance is equal to a distance from the ends of the conductive wires to holes formed in the conductive wires for the leads to pass through, thereby allowing the bottom of the LED unit to abut against the ends of the conductive wires.

In the disclosed LED string light, given that the distance from the bottom of the LED unit to where the leads of the LED unit are partially bent is equal to the distance from the ends of the conductive wires to the holes in the conductive wires for the leads to pass through, the LED string light is manufactured by first mechanically bending the leads of the LED unit at right angle at a position with a fixed distance from the bottom of the LED unit. Then, the conductive wires, which have been inserted respectively into the two through holes in the enclosure in advance, are attached with a boring jig, leaving a portion of the conductive wires above the enclosure with a length equal to the fixed distance, and the conductive wires are drilled at a distance from the ends of the conductive wires that is equal to the fixed distance. After that, the bent portions of the leads of the LED unit are directly inserted into the holes of the conductive wires while being perpendicular to the conductive wires, so that the bottom of the LED unit abuts against the ends of the conductive wires. Finally, the enclosure is moved upward to a connecting portion between the conductive wires and the LED unit to enclose the lower portion of the LED unit and part of the conductive wires. The foregoing process is performed for all the LED units, conductive wires, and enclosures until the LED string light according to the present invention is completed.

With the aforesaid simple configuration and easy production process, the LED string light according to the present invention is mass-produced in a concise manner with reduced labor requirement and low production cost, thus increasing economic advantage of the LED string light.

In addition, owing to its linear structure, the LED string light according to the present invention is set up, windingly if necessary, wherever a lighting or decorative effect is desired. For example, the LED string light is wound around Christmas trees and street trees as a decorative light.

The LED units in the LED string light according to the present invention can be light-emitting units that emit light of various colors. Hence, proper selection and combination of the colors of light emitted by the LED units of the LED string light according to the present invention brings a desired colorful lighting effect.

During manufacture, the conductive wires of the LED string light according to the present invention are inserted into the through holes of the enclosure in advance and then drilled with a boring jig at a predetermined location on the conductive wires. On the other hand, the LED unit is put in a positioning jig so that the leads of the LED unit are bent at right angle at a position with a predetermined distance from the bottom of the LED unit. Afterward, the bent portions of the leads are inserted into the holes pre-formed in the conductive wires to fix the LED unit in position to the conductive wires. Then, the enclosure is moved to the connecting portion between the LED unit and the conductive wires so that the lower portion of the LED unit and part of the conductive wires are received in the accommodating space of the enclosure. The foregoing steps are performed for all the LED units, conductive wires, and enclosures to complete the LED string light according to the present invention.

The LED units in the LED string light of the present invention can be connected in series or in parallel. For series connection, the anode and the cathode of one LED unit are connected to the cathode and the anode of an adjacent LED unit, respectively. For parallel connection, the anode and the cathode of one LED unit are connected to the anode and the cathode of an adjacent LED unit, respectively.

BRIEF DESCRIPTION OF THE SEVERAL VIEWS OF THE DRAWINGS

The invention as well as a preferred mode of use, further objectives and advantages thereof will be best understood by referring to the following detailed description of illustrative embodiments in conjunction with the accompanying drawings, wherein.

DETAILED DESCRIPTION OF THE INVENTION

Figure 1:
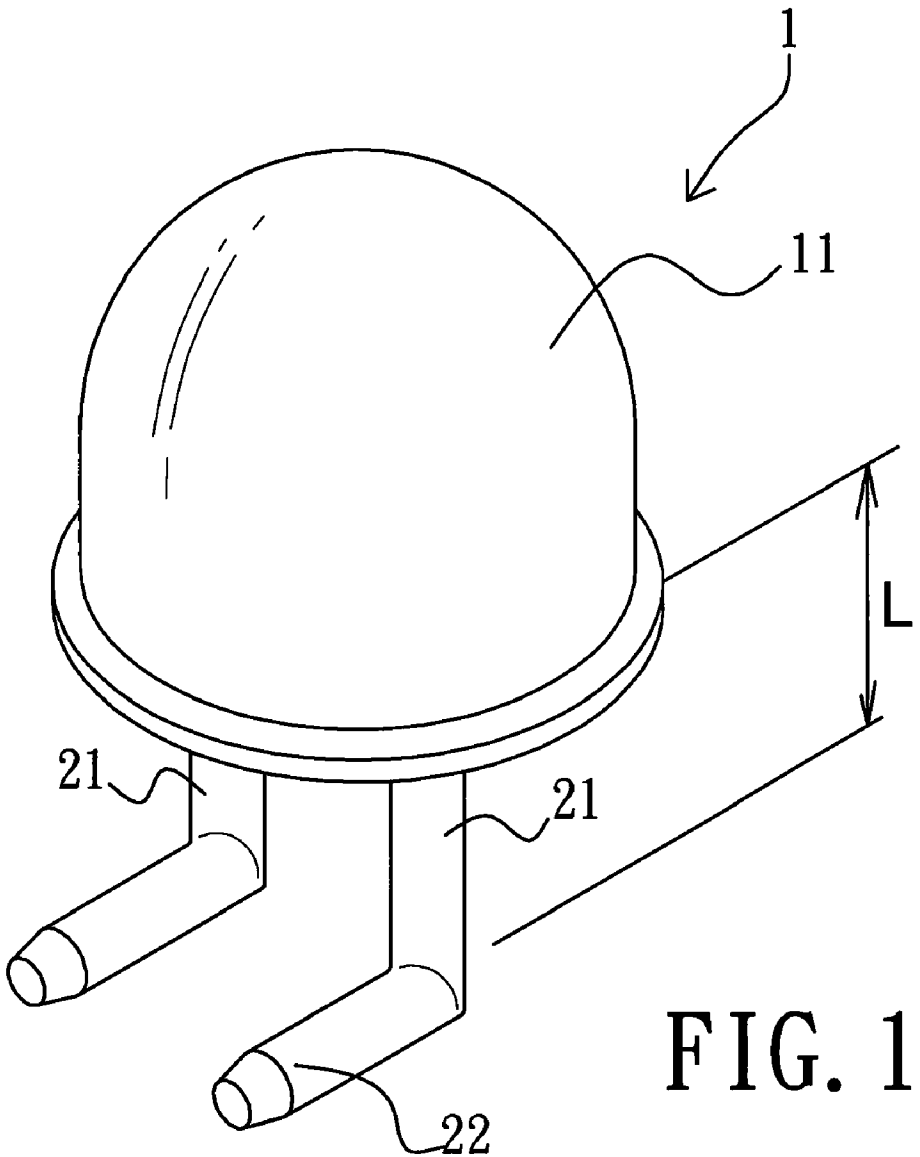
FIG. 1 is a perspective view of an LED unit according to the present invention.
Figure 2:
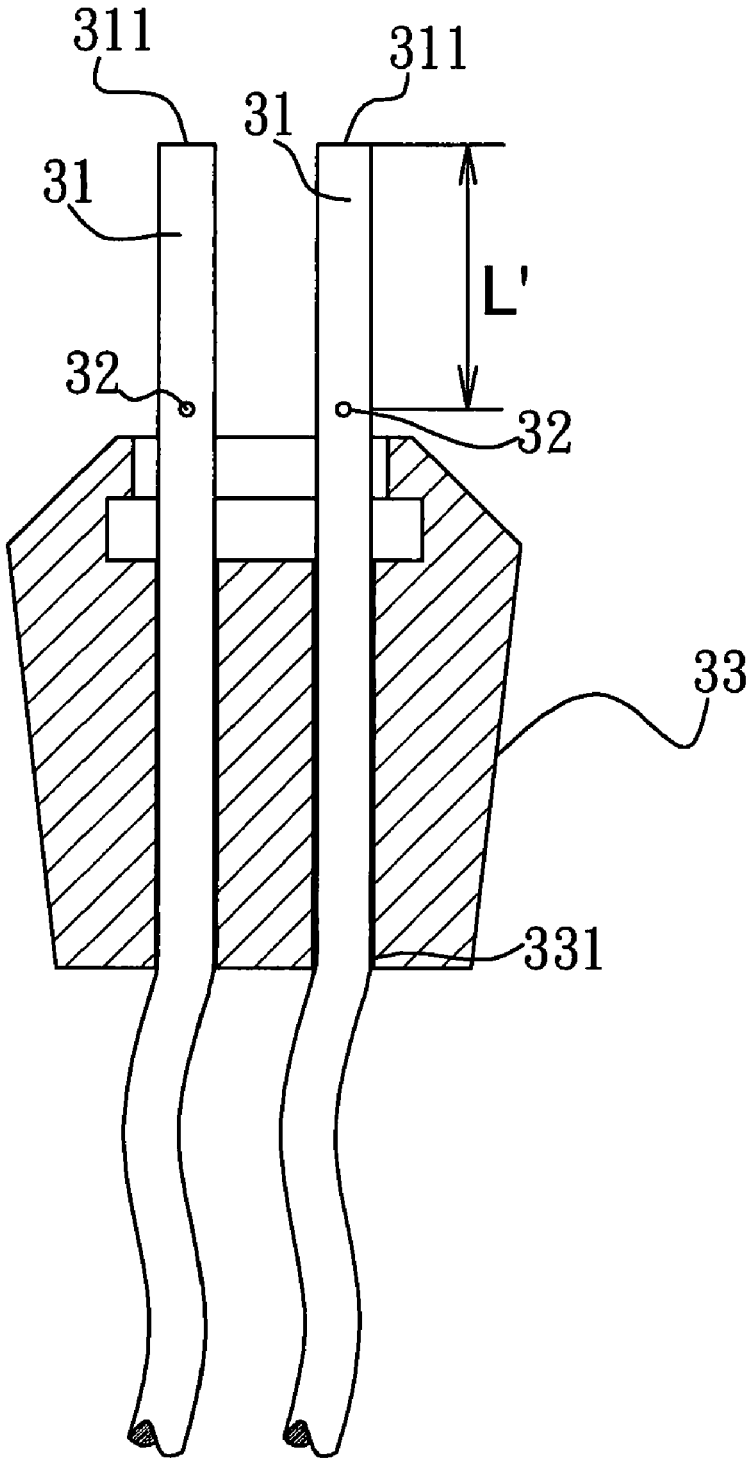
FIG. 2 is a partially sectional view showing conductive wires inserted into an enclosure according to a first embodiment of the present invention.
Figure 3:
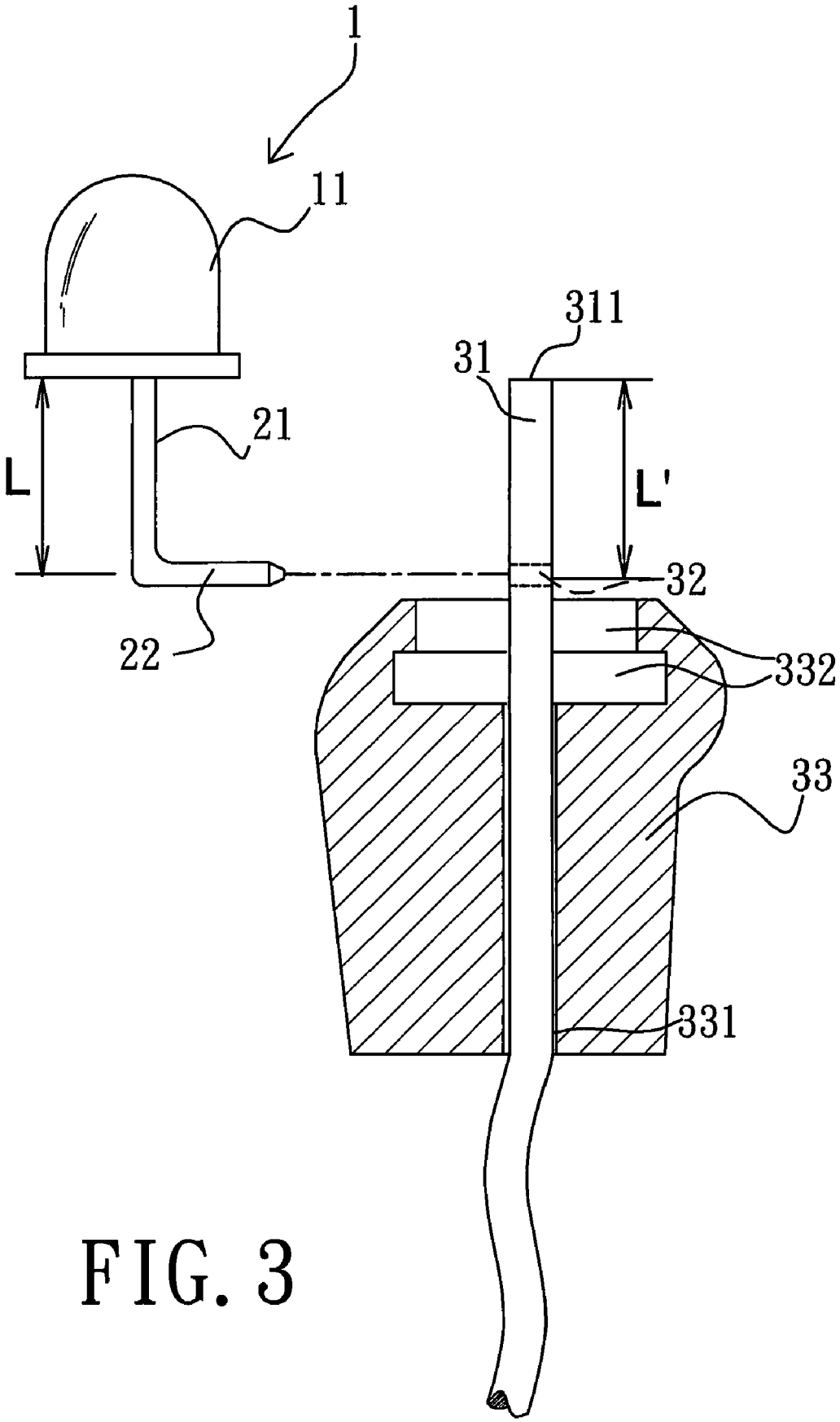
FIG. 3 is a partially sectional view showing alignment between the LED unit and the conductive wires according to the first embodiment of the present invention.
Figure 4:
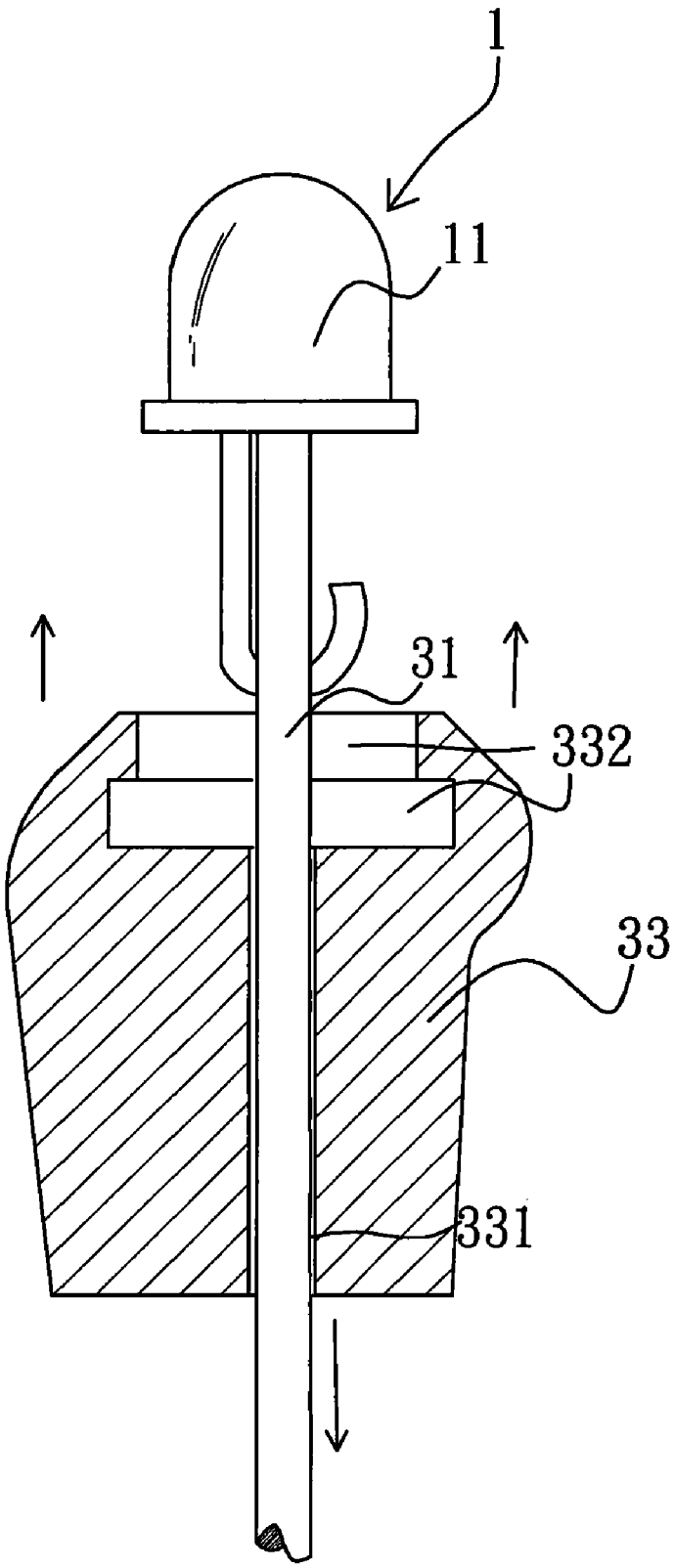
FIG. 4 and FIG. 5 are partially sectional views showing different stages of a process for assembling the LED unit, the conductive wires, and the enclosure according to the first embodiment of the present invention.
Figure 5:
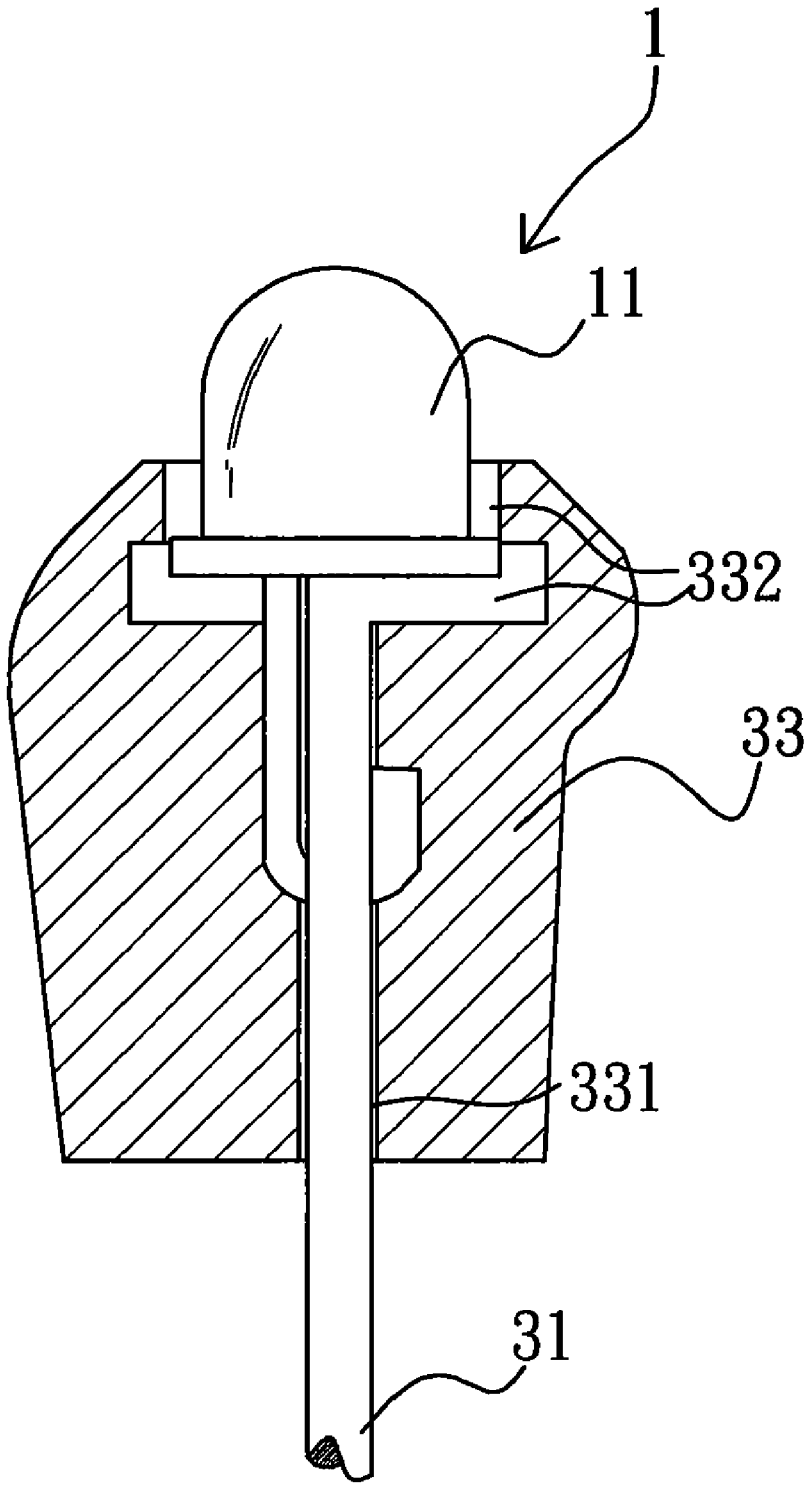

The present invention provides an LED string light including at least two conductive wires, a plurality of LED units, and a plurality of enclosures. The LED string light is technically characterized in that each of the LED units has leads inserted perpendicularly into the conductive wires to establish electrical connection therebetween and allow the bottom of the LED unit to abut against ends of the conductive wires. FIGS. 1 and 2 show the LED unit and the conductive wires according to the present invention, respectively, while FIG. 3 shows alignment therebetween. FIGS. 4 and 5 further show different stages of a process for assembling the LED unit, the conductive wires, and the enclosure according to the present invention. Referring to FIG. 1 for a perspective view of the LED unit according to the present invention, an LED unit 1 includes a main body 11 having the bottom thereof provided with two leads. The leads are bent at 90° at a position with a fixed distance L from the bottom of the LED unit 1 to form leads 21, 21 and leads 22, 22. Referring to FIG. 2 for a partially sectional view showing the conductive wires inserted into the enclosure according to a first embodiment of the present invention, an enclosure 33 is formed therein with two through holes 331 for two conductive wires 31, 31 to pass through, respectively. The enclosure 33 has an upper end provided with an accommodating space 332 (shown in FIGS. 3, 4, and 5) for receiving and enclosing a lower portion of the LED unit 1 and part of the conductive wires 31, 31. The two conductive wires 31, 31 are inserted into the through holes 331 of the enclosure 33 in advance. The conductive wires 31, 31 are formed with holes 32, 32 in advance, respectively. The holes 32, 32 are spaced from corresponding ends 311, 311 of the conductive wires 31, 31 by a distance L', wherein the distance L' is equal to the distance L of the leads 21, 21 of the LED unit 1 in FIG. 1.

Please refer to FIGS. 3 to 5, wherein FIG. 3 shows alignment between the LED unit 1 and the conductive wires 31, and FIGS. 4 and 5 show different stages of a process for assembling the LED unit 1, the conductive wires 31, and the enclosure 33. The leads 22 of the LED unit 1 are first aligned with the holes 32 of the conductive wires 31 and then inserted into the holes 32 perpendicularly to the conductive wires 31. Thus, the bottom of the LED unit 1 abuts against the ends 311 of the conductive wires 31, as shown in FIG. 4. Next, the enclosure 33 is moved toward the ends 311 of the conductive wires 31 so that under the action of the enclosure 33, a portion of the leads 22 that protrude from the conductive wires 31 is bent toward the ends 311 of the conductive wires 31 and then received in the through holes 331 of the enclosure 33. Meanwhile, the lower portion of the LED unit 1 and the ends 311 of the conductive wires 31 are both received in the accommodating space 332, as shown in FIG. 5. The foregoing steps for assembling the LED unit 1, the conductive wires 31, and the enclosure 33 are performed for all the LED units, conductive wires, and enclosures to complete the LED string light according to the present invention.

According to the LED string light disclosed above, the pre-formed holes 32 of the conductive wires 31 also serve as positioning mark to facilitate assembly, and the leads of the LED unit 1 are bent corresponding in position to the holes 32. Therefore, during assembly, the LED unit 1 is directly aligned with and precisely inserted into the holes 32, thereby not only saving the time and labor otherwise required for assembly, but also preventing errors in the position of the leads relative to the conductive wires 31 which might otherwise occur due to misjudgment by assembly workers. In consequence, the throughput and efficiency of production are both increased while production time is significantly reduced.

In FIGS. 1 through 5, the LED units of the LED string light according to the present invention are connected in series. However, the LED units can also be connected in parallel in the LED string light according to the present invention, as explained below.

Figure 6:
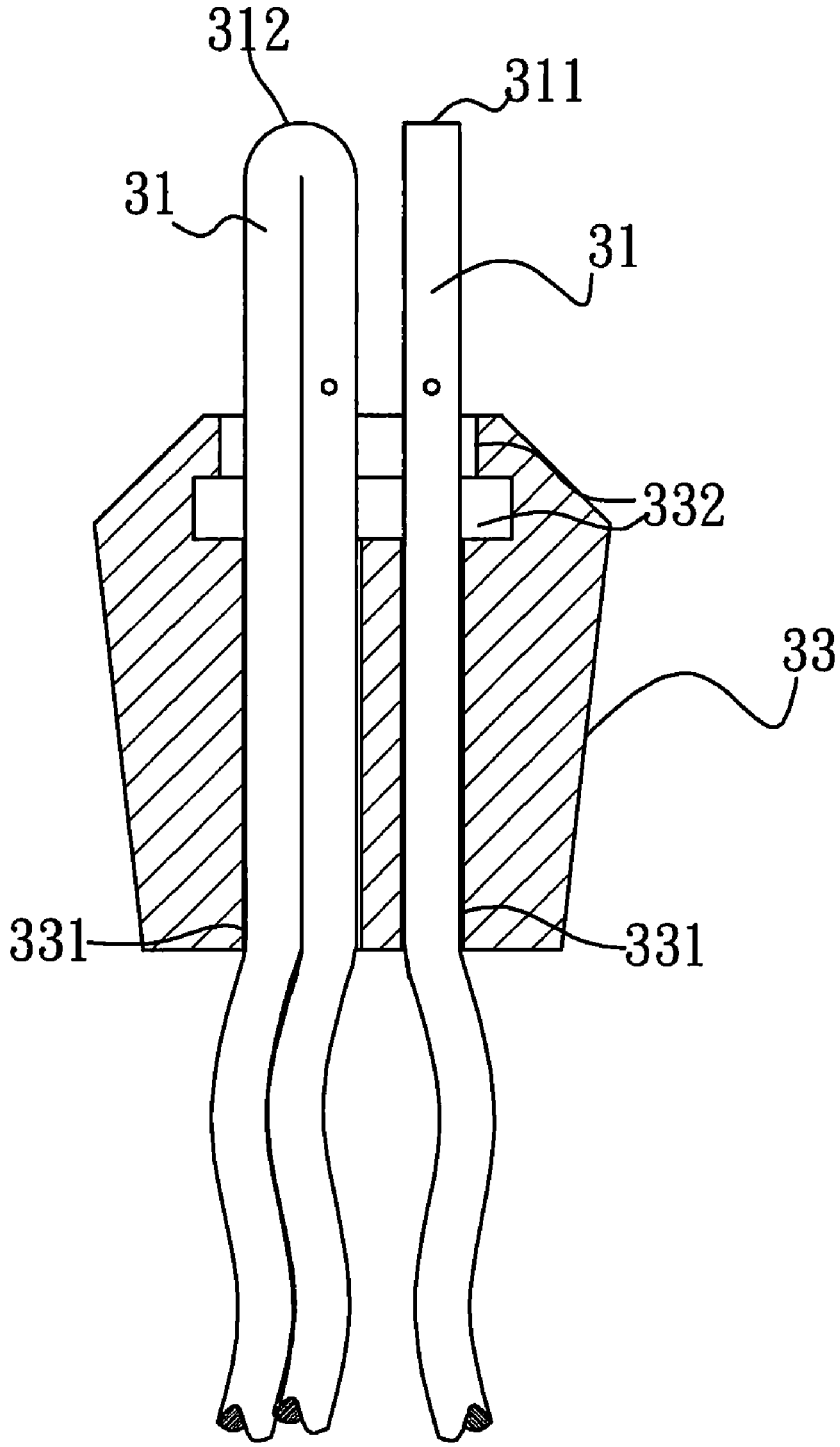
FIG. 6 is a partially sectional view showing conductive wires inserted into an enclosure according to a second embodiment of the present invention.
Figure 7:
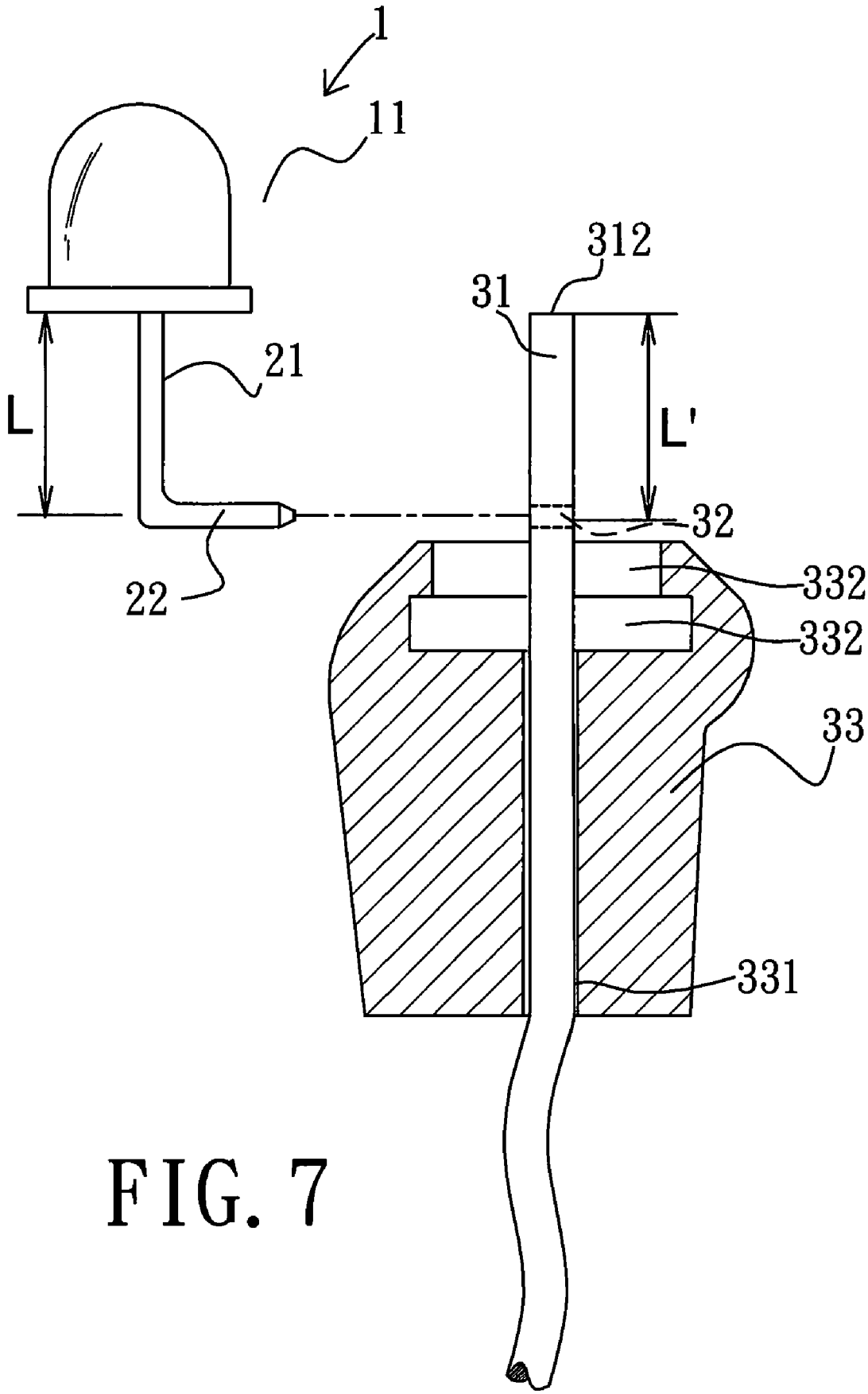
FIG. 7 is a partially sectional view showing alignment between the LED unit and the conductive wires according to the second embodiment of the present invention.

Parallel connection between the LED units of the LED string light according to the present invention is now demonstrated by reference to FIGS. 1, 6, and 7. Referring to FIG. 6 for a partially sectional view showing conductive wires inserted into an enclosure according to a second embodiment of the present invention, an enclosure 33 is formed therein with two through holes 331, one larger than the other, for two conductive wires 31 to pass through, respectively. The enclosure 33 has an upper end provided with an accommodating space 332 for receiving and enclosing a lower portion of an LED unit 1 and part of the conductive wires 31. One of the conductive wires 31 is folded back and inserted into the larger one of the through holes 331, with both ends of the folded-back conductive wire 31 being connected to adjacent LED units 1, respectively. As shown in FIG. 6, the conductive wire 31 on the left is folded 180° onto itself to form a folded-back end 312. The folded-back end 312 is level with an end 311 of the other conductive wire 31. The conductive wires 31 are formed with holes 32, 32, respectively. The holes 32, 32 are spaced from the corresponding end 311 or end 312 by a distance L', which is equal to the distance L of the leads 21 of the LED unit 1 in FIG. 1. Refer now to FIG. 7 for a partially sectional view showing alignment between the LED unit 1 and the conductive wires 31 according to the second embodiment of the present invention. The LED unit 1 has leads 22 aligned with the holes 32 of the conductive wires 31 and then inserted into the holes 32 perpendicularly to the conductive wires 31, so that the bottom of the LED unit 1 abuts against the ends 311 and 312 of the conductive wires 31. Afterward, the enclosure 33 is pushed toward the ends 311 and 312 of the conductive wires 31 or, alternatively, the conductive wires 31 are pulled downward with respective to the enclosure 33. Thus, under the action of the enclosure 33, a portion of the leads 22 that protrudes from the conductive wires 31 is bent toward the ends 311 and 312 of the conductive wires 31 and received in the through holes 331 of the enclosure 33. Meanwhile, the lower portion of the LED unit 1 and the ends 311 and 312 of the conductive wires 31 are received in the accommodating space 332, thereby concluding a process for assembling the LED unit 1, the conductive wires 31, and the enclosure 33, wherein the folded-back conductive wire 31 is further connected to the next LED unit. The LED string light according to the present invention is completed by performing the steps described above on all the LED units, conductive wires, and enclosures.

In the first embodiment of the present invention as illustrated in FIGS. 1 through 5, each of the conductive wires 31 is connected between the anode of one LED unit to the cathode of an adjacent LED unit, wherein the anode of the first LED unit is connected to the anode of a rectifier (not shown), and the cathode of the last LED unit is connected to the ground end of the rectifier. In this embodiment, a series connection structure is provided that is ideal for home decoration, such as being wound around Christmas trees, as well as party decoration, so as to produce a beautifying and decorative effect.

In the second embodiment of the present invention as depicted in FIGS. 1, 6, and 7, the LED string light makes a parallel-connected circuit. A parallel-connected circuit differs from a series-connected circuit in the following way. A series-connected circuit consists of a single loop. If any element in the loop is damaged, the entire circuit is broken, and all the other elements will not work. On the contrary, a parallel-connected circuit consists of a plurality of loops. Taking for example the LED string light according to the second embodiment of the present invention, should one of the parallel-connected LED units be damaged, a user can easily locate the damaged LED unit while all the other LED units are in normal operation. Therefore, a parallel-connected LED string light is suitable for decorating street trees and may produce a colorful, sparkling effect when used with an oscillator and LED units capable of emitting light of different colors.

The invention claimed is:

1. A light-emitting diode (LED) string light, comprising at least two conductive wires, a plurality of LED units, and a plurality of enclosures, the LED string light being characterized in that:

each said LED unit has leads inserted perpendicularly into the conductive wires to achieve electrical connection therebetween and allow a bottom of each said LED unit to abut against ends of the conductive wires; and each said enclosure has two through holes formed therein for the conductive wires to pass through, respectively, and an upper end provided with an accommodating space for receiving and enclosing a lower portion of a corresponding said LED unit and part of the conductive wires.

2. The LED string light of claim 1, wherein the leads of each said LED unit are bent at a distance from the bottom of each said LED unit, the distance being equal to a distance from the ends of the conductive wires to a location on the conductive wires where the leads are inserted thereinto.

3. The LED string light of claim 1, wherein the through holes of each said enclosure are same in size.

4. The LED string light of claim 3, wherein the conductive wires are directly inserted into the through holes, respectively.

5. The LED string light of claim 1, wherein the through holes of each said enclosure are different in size.

6. The LED string light of claim 5, wherein one of the conductive wires is folded back and inserted into a larger one of the through holes.

* * * * *